US006681860B1

(12) United States Patent
Yokley et al.

(10) Patent No.: US 6,681,860 B1
(45) Date of Patent: Jan. 27, 2004

(54) DOWNHOLE TOOL WITH PORT ISOLATION

(75) Inventors: John M. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 39 days.

(21) Appl. No.: 10/004,945

(22) Filed: Dec. 4, 2001

Related U.S. Application Data

(60) Provisional application No. 60/292,049, filed on May 18, 2001.

(51) Int. Cl.[7] ..... E21B 23/00

(52) U.S. Cl. ..... 166/382; 166/208; 166/212

(58) Field of Search ..... 166/208, 212, 166/317, 318, 319, 332.1, 332.3, 332.4

(56) References Cited

U.S. PATENT DOCUMENTS 4,096,913 A * 6/1978 Kenneday et al. ..... 166/290
4,249,601 A * 2/1981 White ..... 166/208
4,393,931 A * 7/1983 Muse et al. ..... 166/208
4,825,037 A 4/1989 Spaude
5,038,860 A * 8/1991 Baugh et al. ..... 166/208
5,244,044 A 9/1993 Henderson
5,318,131 A * 6/1994 Baker ..... 166/382
5,553,672 A 9/1996 Smith, Jr. et al.
5,884,702 A 3/1999 Yokley et al.
5,968,881 A 10/1999 Haeggberg et al.
6,009,943 A 1/2000 Yokley et al.
6,032,734 A * 3/2000 Telfer ..... 166/66.5

OTHER PUBLICATIONS

US 4,926,939, 5/1990, Baugh (withdrawn)

* cited by examiner

*Primary Examiner*—Frank Tsay
(74) *Attorney, Agent, or Firm*—Browning Bushman

(57) ABSTRACT

A retrievable hydraulically operated running tool 10, 50 is run in a wellbore to preform a desired downhole tool activation. The port closure member 14, 52 is movable with a tubular body 12 from a port isolation position to an open port position. A seat 18, 56 supported on the port closure member receives a plug to shift the port closure member to the open port position, wherein the port 32, 56 exposes increased fluid pressure to the piston 24, 58, 70 to move to an activated position. The seat may be deformable for release in the plug from the seat after the port closure member has moved the open port position.

21 Claims, 6 Drawing Sheets

DOWNHOLE TOOL WITH PORT ISOLATION

RELATED APPLICATION

This application claims the benefit of priority from U.S. Provisional Application No. 60/292,049 filed May 18, 2001.

FIELD OF THE INVENTION

The present invention relates to retrievable downhole tools used in hydraulically actuating components in a well. More particularly, this invention achieves significantly increased control of the downhole tool by isolating the inlet port to the hydraulic actuating mechanism of the tool. The downhole tool may be a retrievable running tool used in a liner hanger setting operation, and may include a port isolation for controlling fluid pressure to set a slip of a liner hanger, or to release the running tool from the set liner hanger in order to retrieve the running tool to the surface.

BACKGROUND OF THE INVENTION

Various downhole tools include hydraulic actuating mechanism which are responsive to fluid pressure to move downhole component from an unset position to a set position. For example, a liner hanger running tool is conventionally operated by dropping a ball through the liner hanger to seal on a seat of a landing collar at the lower end of the liner. A ball lands on the seat to increase fluid pressure within the liner hanger setting assembly to set the slips on the running tool. Subsequently, fluid pressure in the running tool may also be used to release the running tool from the set liner hanger.

A significant problem with hydraulically actuated downhole tools is that such tools may prematurely move the actuating mechanism and thus prematurely "set" the tool due to an unexpected increase in fluid pressure in the running string and thus within the tool. Hydraulically activated downhole tools may thus be prematurely set either when running the tool to its desired location within the well, or when the tool is positioned at its desired location but before the particular actuating mechanism was intended to be set. Various attempts to reduce this premature setting problem have not been commercially successful.

In an attempt to avoid the above described problems, some downhole tools have used pick up and latching techniques in a setting tool to form a pressure chamber that then allows the packer to be set, as disclosed in U.S. Pat. Nos. 6,009,943 and 5,884,702. Other systems have been attempted to use a complex rotary ball valve mechanism which rotates about the ball seat, as disclosed in U.S. Pat. No. 5,553,672. U.S. Pat. No. 5,968,881 discloses a ball seat which is shifted to close off a port in a surge protection tool after a ball lands on the seat. Port isolation techniques have also been used in downhole washing tools for washing down a liner.

Various downhole tools utilize a segmented ball seat with collet fingers which are shifted from a contracted position to an expanded position to allow a ball to drop through the segmented ball seat, as shown in U.S. Pat. Nos. 4,825,037, 4,926,939 and 5,244,044. These segmented ball seat designs include collet fingers which may fail to seal properly with the ball, thereby preventing the required pressure build up so that the collet fingers may expand and let the ball drop through the seat. Moreover, wellbore fluids that pass between the collet fingers cause erosion and may result in failure of the ball seat.

Many downhole running tools which are used to conduct wellbore operations must have a sizeable throughbore in the central body of the tool, either for passing a required amount of fluid with a relatively low pressure drop, or for allowing another tool, such as a ball, a plug, or a wireline tool, to freely pass through the bore of the running tool while in the well. In liner hanger setting operations, this through bore in the liner hanger setting tool may be sized to pass balls or plugs which are used to set the liner hanger and to conduct cementing operations. Consequently, many liner hanger setting operations land the ball in the landing collar at the lower end of the liner, as described above, to increase fluid pressure to the setting port. Other liner hanger setting tools avoid the benefits of a hydraulically actuated tool and instead use mechanical pick up and latching techniques to set the liner hanger within the well.

The disadvantages of the prior art are overcome by the present invention, and an improved running tool and method of hydraulically actuating a downhole tool are hereinafter disclosed.

SUMMARY OF THE INVENTION

In one embodiment, the retrievable hydraulically operated running tool includes a tubular body for suspending in the wellbore from a conveyance tubular, a piston in fluid communication with a fluid inlet port in the tubular body and moveable from an initial position to an activated position in response to fluid pressure, a port isolation sleeve axially moveable with respect to the tubular body from a port isolation position to an open port position, a seat supported on the sleeve such that fluid pressure increases when a ball lands to shift the sleeve, and a release mechanism for releasing the ball from the seat. The hydraulically operated running tool may be used, for example, as a liner hanger running tool to perform a selected operation as part of the overall liner hanger setting operation. The ball may land on the seat to substantially seal off the bore in the tubular body. The seat may thereafter be permanently deformed in response to increased fluid pressure to pass the ball through the seat, or the seat may otherwise yield or release the ball from the seat.

It is an object of the present invention to provide a method of operating a retrievable running tool of the type discussed above. The port isolation technique of the present invention provides a substantially reliable method of performing a downhole tool activation with a significantly decreased risk that the downhole tool will be prematurely activated.

It is an object of the present invention to provide a hydraulically actuated running tool which reliably prevents premature actuation by controllably isolating the inlet port to the hydraulic actuating mechanism of the tool.

A related object of the invention is to provide a downhole tool with a port isolation system which maintains a large throughbore through the running tool.

It is a significant feature of the invention that the hydraulically activated downhole tool will not prematurely activate in response to either an over-pressure condition within the bore of the tool.

It is a feature of the present invention that the running tool of the present invention may be used in a liner hanger setting operation. A ball may be landed on a seat within a sleeve which isolates the inlet port to set the slips and thus hang off the liner within the casing. Another sleeve may provide port isolation for hydraulically releasing the running tool from the set liner hanger. In each case, the ball lands on the seat and shifts the sleeve to open the inlet port, so that fluid pressure within the running tool may then be used to achieve the desired downhole actuation. Accordingly, the actuating mechanism is prevented by the sleeve from prematurely setting the running tool. The ball is landed on a seat and shifts the sleeve so that pressure can thereafter hydraulically actuate the running tool with the open inlet port. The ball may thereafter be pumped through the seat, which may be permanently deformed to enlarge the through bore in the running tool or otherwise yield to release the ball from the seat. The ball may then be pumped to a lower seat on another shiftable sleeve, or may be pumped to a ball catch either within the running tool or at the lower end of the tubular string.

A significant advantage of the present invention is that the complexity of the running tool is not significantly increased, conventional well operating procedures are utilized, and the reliability of the downhole tool performing its desired operation when intended is significantly increased utilizing components which individually are well known in the art. Operators of wells have long desired improved running tools and methods which increase tool reliability and thus reduce the risk of either a prematurely set liner hanger or a prematurely released running tool.

These and further objects, features and advantages of the present invention will become apparent from the following detailed description, wherein reference is made to the figures in the accompanying drawings.

DETAILED DESCRIPTION OF PREFERRED EMBODIMENTS

Figure 1:
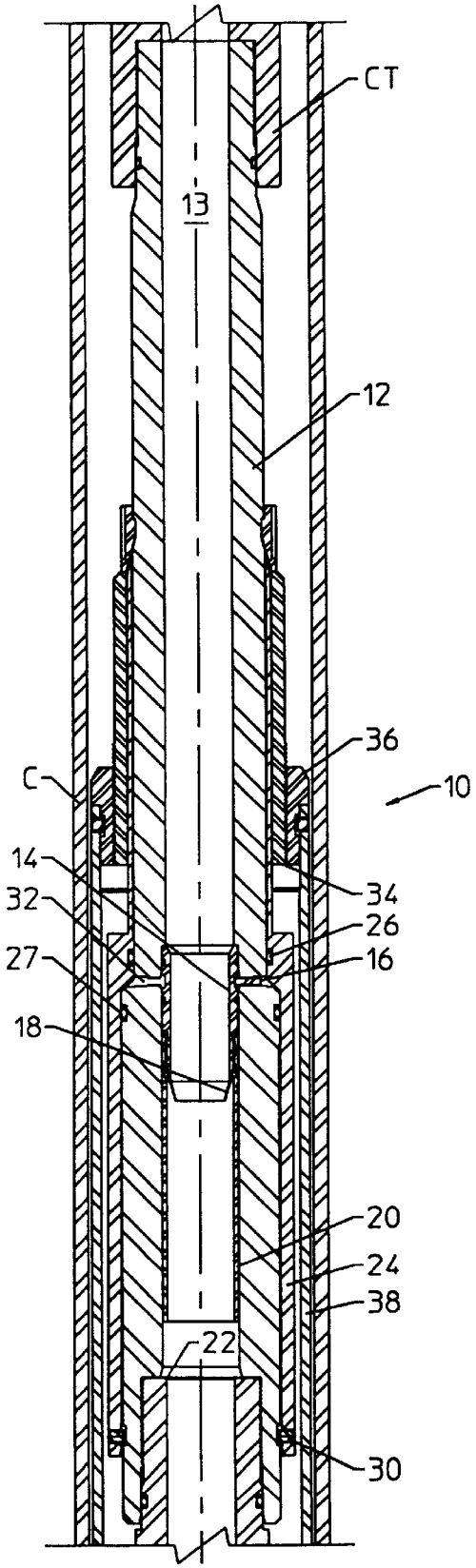
FIG. 1 is a vertical cross sectional view of a slip actuating portion of the running tool according to the present invention, wherein the running tool includes a hydraulically actuated piston which is sealed off from pressure within the bore of the running tool by a sleeve. The hydraulically shifted piston may set slips on a liner hanger.

FIG. 1 illustrates the upper portion of a running tool 10 with the port isolation system according to the present invention. The running tool may be used as a liner hanger running tool, and the portion of the running tool shown in FIG. 1 may be activated to result in setting slips to hang off the liner hanger (not shown) from the casing C. The running tool includes a tubular body 12 which is suspended in the wellbore from a conveyance tubular CT. The bore 13 within the running tool is in communication with the bore of the conveyance tubular so that fluid may be pumped downhole through the conveyance tubular and the tubular body 12.

Figure 2:
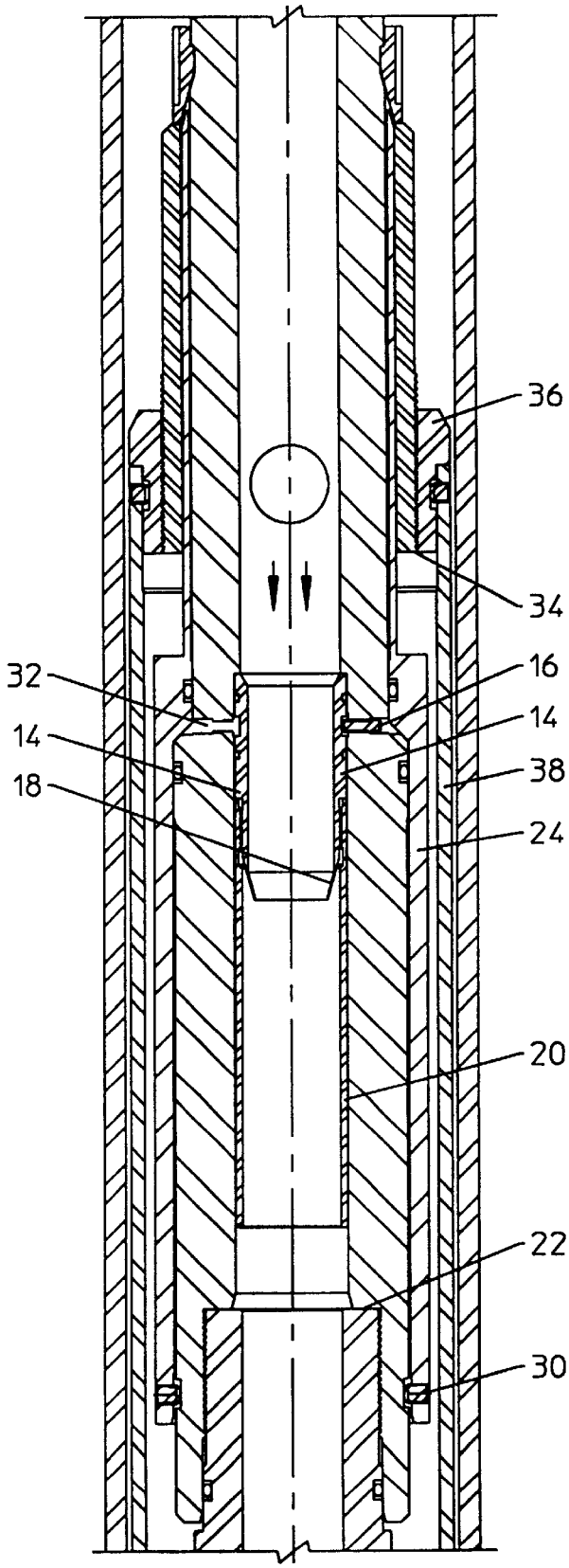
FIG. 2 illustrates the slip actuating portion of the running tool shown in FIG. 1, with a ball landed on the seat and the sleeve shifted to open the inlet port.

In the FIG. 1 embodiment, a port closure member 14, which preferably is sleeve-shaped, is temporarily interconnected with the tubular body 12 by shear pins 16. The sleeve 14 includes a seat 18 for landing a ball on the seat to shear the pins 16, as shown in FIG. 2, and move the sleeve 14 from the port isolation position as shown in FIG. 1 to the open port position as shown in FIG. 2, where a sleeve extension 20 has landed on the shoulder 22, with the seat 18 being positioned substantially above the shoulder.

When the pins 16 shear, high fluid pressure in the bore 13 above the ball passes through the one or more fluid inlet ports 32 in the body 12. Those skilled in the art will appreciate that conventional seals may be provided on the sleeve 14 for sealing with the tubular body 12 above and below the ports 32 when the sleeve is in the port isolation position. Downward movement of the sleeve 14 allows fluid pressure to pass through either a port which included a shear pin or through another open port, so that fluid pressure may act on the piston 24. In a preferred embodiment, the piston 24 includes an ID seal 26 which has a diameter less than the OD seal 27 on the body 12, so that the piston 24 moves axially upward from a position shown in FIG. 2 to the position shown in FIG. 3. More particularly, the top end of the piston 24 engages the lower surface 34 of head member 36, so that continued upward movement of the piston 24 moves the slip setting sleeve 38 upward which then sets the slips to hang off the liner from the casing. In a preferred application for setting slips, the piston 24 may be connected to the body 12 by one or more shear pins 30, so that a desired fluid pressure level within the bore 13 will shear the pins 30 and initiate upward movement of the piston to set the slips.

After the sleeve 14 has moved downward to open the ports 32 to shift the piston upward, fluid pressure is further increased within the bore 13 to expel the ball from the seat 18. In one embodiment, the ball release mechanism includes a seat 18 which is permanently deformed in response to increased fluid pressure to pass the ball through the seat. This deformation of the seat 18 thus allows the ball to be pumped through the seat, and also desirably results in a large diameter bore through the tool after the ball is released. In an alternative ball release mechanism, a c-shaped seat may be provided which does not form a fluid tight seal with the ball, and instead a separate seal above the ball seat is provided. Increased fluid pressure may cause the C-ring to expand into a slot to release the ball from the body 12. In yet another embodiment, a collet mechanism may be provided to form a segmented ball seat. Some fluid leakage through the segmented ball seat may be permissible in some applications, and in other applications a separate seal may be provided above the segmented ball seat for sealing with the ball.

For many operations, including a liner hanger setting operation, a piston is axially moveable upward from its initial position to its activated position in response to fluid pressure when the fluid inlet port is opened. The running tool may include one or more fluid pressure responsive members other than a piston which nevertheless are moveable from an initial position to the activated position in response to fluid pressure. The increased fluid pressure to the responsive member when the port is open could rupture a disk which serves as a barrier between different fluid pressures, so that the position of the disk in its blocking condition was moved to an activated position wherein the disk ruptured in response to the increased fluid pressure. The fluid pressure responsive member also could be a switch which was activated in response to increased fluid pressure to perform a desired downhole operation with the running tool.

The preferred type of plug for engaging the seat and thereafter pumping through the seat for many operations will be a ball, which is highly reliable. In other applications, a different type of plug could land on the seat, and subsequently be pumped through the seat. In another embodiment, the ball or plug may be deformed, either within its elastic range or beyond its elastic limit, so that the reduced diameter ball or plug was pumped through the seat under high pressure. In yet another embodiment, both the ball and the seat may be released after shifting to the open port position.

Figure 3:
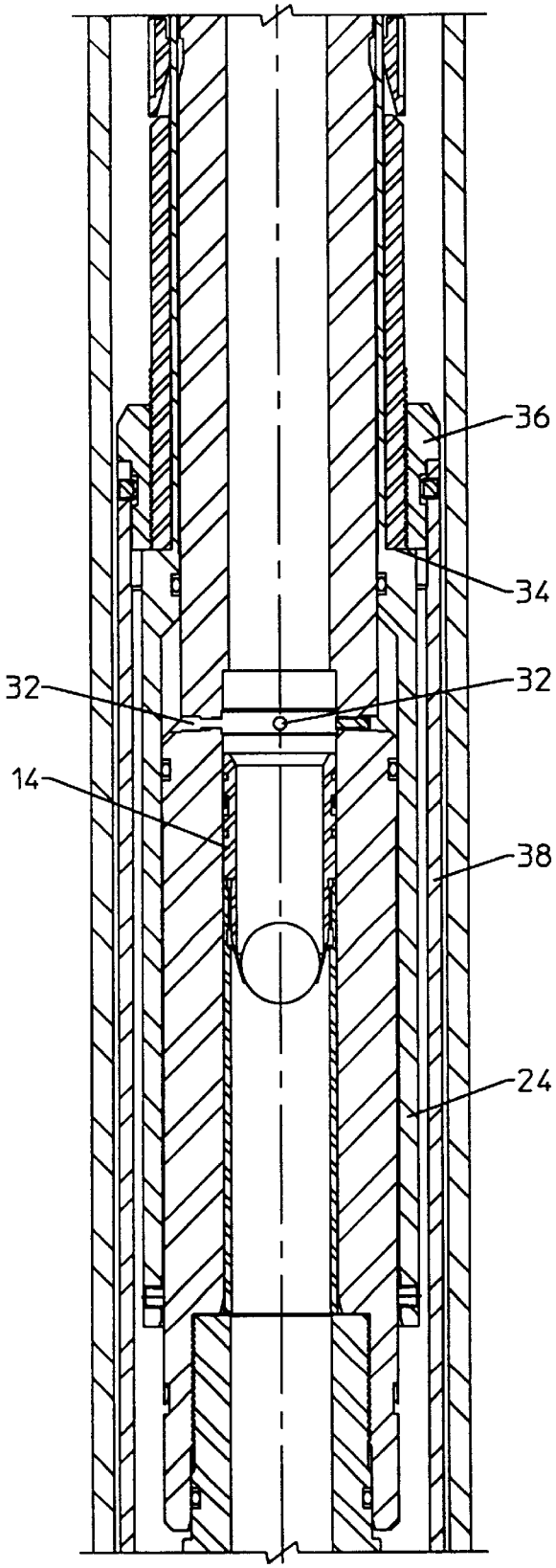
FIG. 3 illustrates the slip actuating portion of the running tool as shown in FIGS. 1 and 2, with the ball released from the seat.

A significant advantage of using a seat which is permanently deformed in response to high fluid pressure is that the ball lands on the seat to seal off or substantially seal off the bore through the tubular body, and thus a separate seal is not required to thereafter increase fluid pressure in the running tool. The sleeve 14 as shown in FIGS. 1–3 is initially retained in the port isolation position by the shear pins 16. Those skilled in the art will appreciate that various types of shear members, including pins and shear rings, may be used to temporarily connect the sleeve 14 to the body 12. In other applications, the shear pins may be eliminated and a biasing member, such as a spring, may be used to initially maintain the sleeve in the port isolation position. Fluid pressure increased to a desired level will then overcome the biasing force of the spring and began to move the sleeve downward.

A preferred sequence of operations for many applications involves moving the sleeve or other port closure member from the closed port position to the open port position, actuating the piston or other fluid pressure responsive member, then releasing the ball from the seat to open the bore in the running tool. Alternatively, the ball could be released from the seat after moving to the open port position, and then the ball could be landed on a lower seat or collar, so that the subsequent increase in fluid pressure within the running tool passing through the open port activated the piston or other fluid pressure member.

The sleeve 14 as shown in FIG. 1 is a preferred configuration of a port closure member which is moveable with respect to the tubular body from the open port position to the closed port position, as discussed above. Other types of port closure members could be provided for initially closing off the fluid inlet port to the piston or other fluid pressure responsive member, then moving to open the port.

Those skilled in the art should appreciate that, for the embodiment shown in FIGS. 1–3, the retrievable running tool uses a port isolation system which significantly reduces the likelihood of the liner hanger becoming prematurely set, or a running tool prematurely released from the liner hanger. A conventional ball may be dropped to land on a seat to shift a sleeve and open the port which then activates a hydraulically movable component of the running tool to perform the downhole tool activation.

Figure 4:
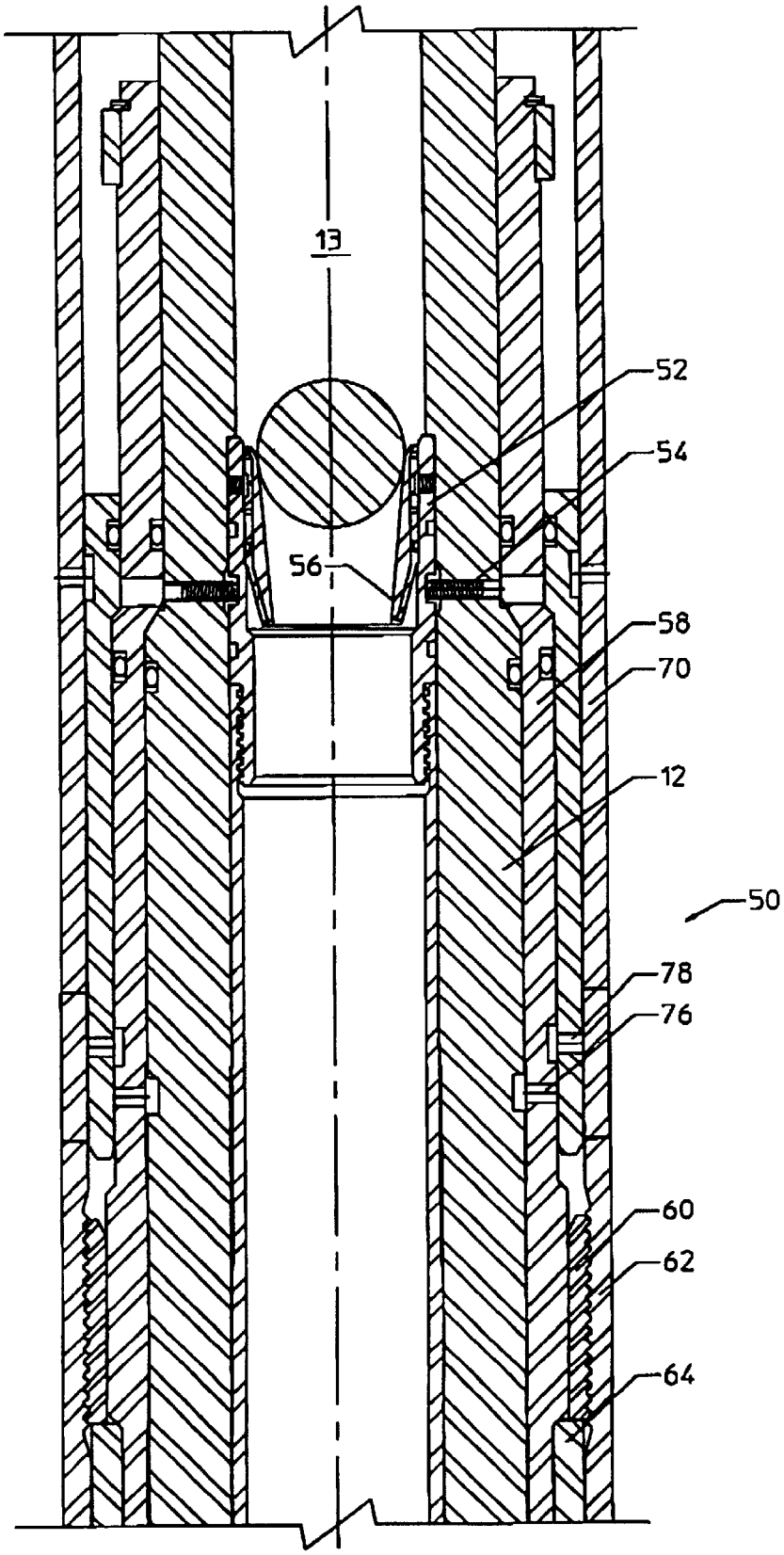
FIG. 4 illustrates a hydraulic release portion of a running tool with the ball landed on the seat, but prior to shifting of the sleeve.
Figure 5:
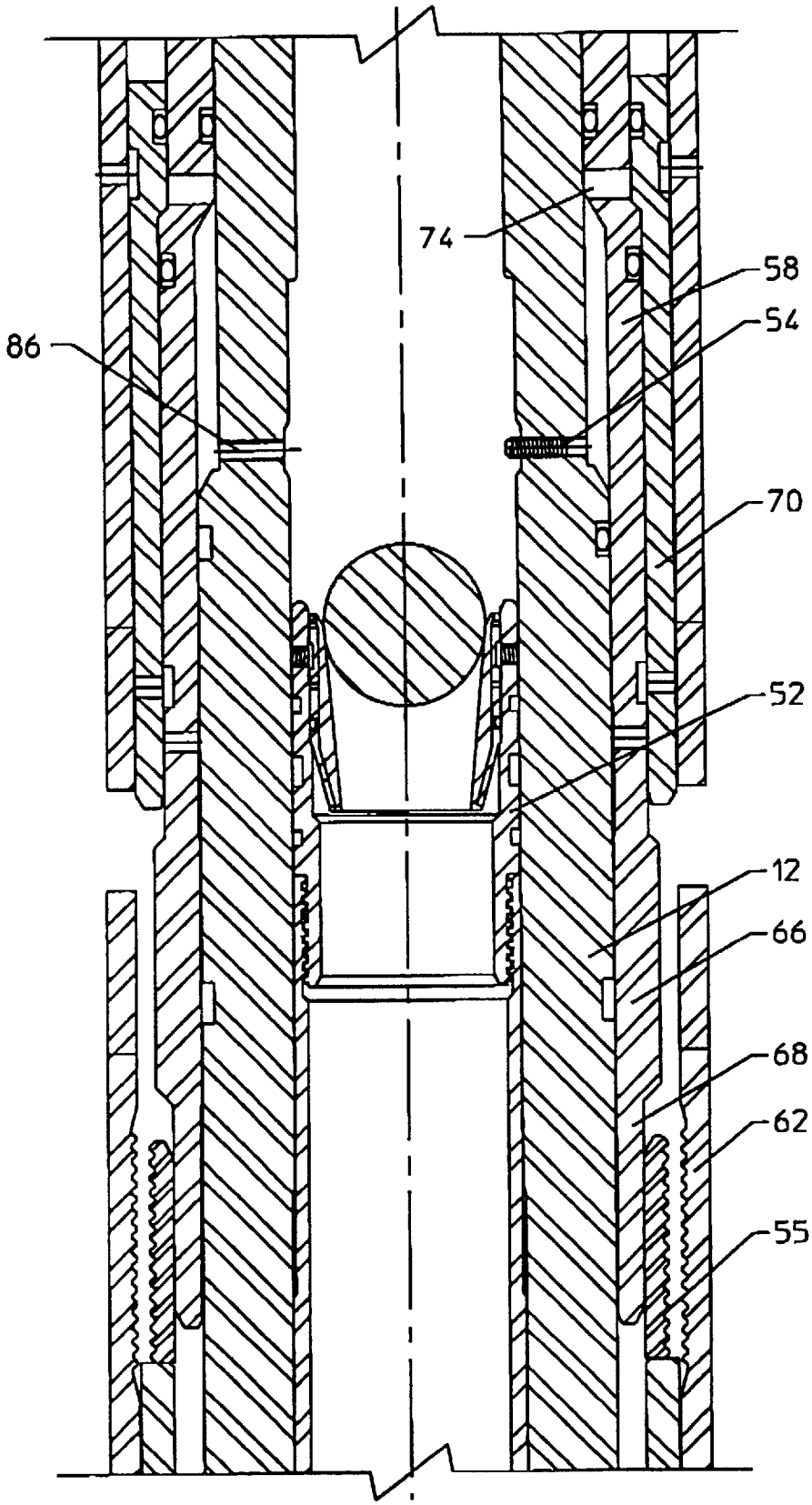
FIG. 5 illustrates the hydraulic release portion of the running tool shown in FIG. 4, with the sleeve shifted to open the port.
Figure 6:
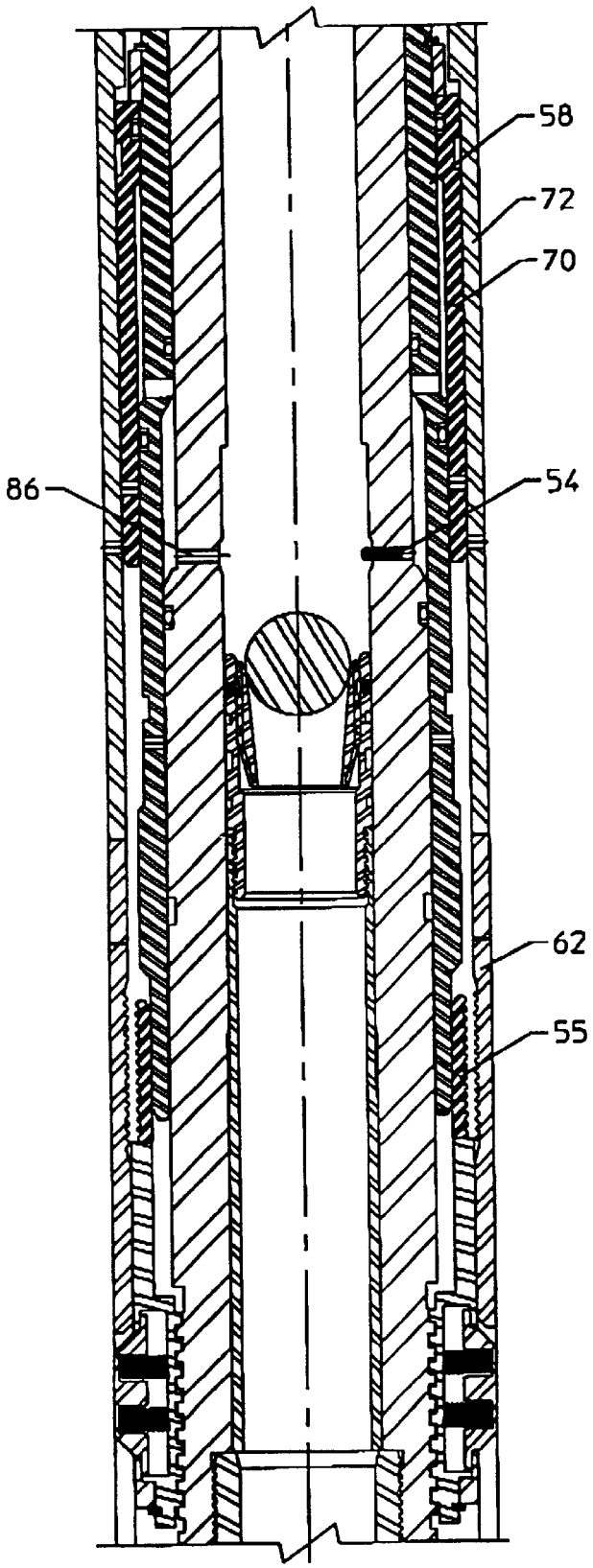
FIG. 6 illustrates the hydraulic release portion of the running tool shown in FIGS. 4 and 5, with an optional second piston moved to an activated position to release the running tool.

FIG. 1 discloses the port isolation system used in the slip setting portion of a running tool. FIGS. 4, 5 and 6 show a similar port isolation system in the hydraulic release assembly 50 for the same liner hanger running tool. The same tubular body 12 with a bore 13 discussed above includes a sleeve 52 which is connected to the body 12 by shear pins 54. In this alternate embodiment, another form of a permanently deformable seat 56 seals with a landed ball. When the sleeve 52 shifts to the open port position as shown in FIG. 5, the port 86 is open to high pressure which moves the piston 58 upward, as shown in FIG. 5.

In the FIG. 4 position, the outer threads of the c-ring 60 were in engagement with the inner threads of the liner hanger 62. The sleeve 64 which is interconnected with the body 12 thus engages the c-ring 60 to prevent the release of the running tool from the liner hanger. When the piston 58 moves upward to the position as shown in FIG. 5, the enlarged diameter portion 66 of the piston moves out from under the c-ring 60, and the reduced diameter portion 68 of the piston allows the c-ring to move radially inward, thereby allowing the running tool with the tubular body 12 to be retrieved to the surface with a liner hanger set in the well. In a preferred embodiment of the liner hanger releasing assembly, a second piston 70 is exposed to the fluid pressure in the wellbore due to the port 74 in the piston 58. A further increase in fluid pressure will thus push up the second piston 70 which allows movement of the outer sleeve 72 relative to the liner hanger 62, thereby engaging a clutch so that right hand rotation of the running string may alternatively mechanically release the running tool from the liner hanger. Shear pin 76 and 78 are provided for ensuring that pistons 58 and 70 do not move until a predetermined fluid pressure exists in the bore 13. Shear pin 76 thus shear first, followed by pin 78. Increased fluid pressure may then shear pin 80, so that sleeve 72 lets the clutch re-engage the top of the liner hanger. Other techniques for hydraulically releasing the running tool from a set liner hanger will be apparent in view of the foregoing description.

In view of the above, those skilled in the art will appreciate that the running tool of the present invention may include a port isolation system which serves many purposes. For a liner hanger running tool, the port isolation system may be used to reliably ensure the setting, and minimizing the likelihood of an unintentional setting, to either (a) axially move a slip to set the liner hanger, (b) move the hydraulic release mechanism to release the liner hanger from the running tool, (c) cause relative movement between a cone and a seal to seal between the liner hanger and the surrounding casing. Moreover, the running tool of the present invention may be used for applications which involve the liner hanger setting either with or without a cementing operation for cementing the liner hanger in the well. The sizable throughbore in the liner hanger running tool may thus be used for passing balls and pump down plugs which may be reliable used in cementing operations. The running tool may also be used to reliably open a port in the running tool which results in the setting of various types of compression set packers, inflatable packers, or radially set packers used in downhole operations.

The method of hydraulically operating a running tool according to the present invention will be apparently from the above discussion. The method may include various types of downhole activations in response to movement of the piston or other fluid pressure responsive member to the activated position after the port closure member has shifted from the port isolation position to the open port position.

While preferred embodiments of the running tool according to the present invention have been illustrated, it is apparent that modifications and adaptions of the preferred embodiments will occur to those skilled in the art. It is to be expressly understood that such modifications and adaptions are within the spirit and scope of the present invention as set forth in the following claims.

What is claimed is:

1. A retrievable hydraulically operated tool for running in a wellbore to perform a downhole tool activation, the tool comprising:

a running tool tubular body for suspending in the wellbore from a conveyance tubular, such that fluid may be circulated through a bore in the conveyance tubular and in the tubular body, the tubular body including a fluid inlet port from the bore in the tubular body;

a fluid pressure responsive member in fluid communication with the fluid inlet port and moveable relative to the tubular body from an initial position to an activated position in response to fluid pressure within the tubular body;

a port closure member moveable with respect to the tubular body from a port isolation position to an open port position, the port closure member in the port isolation position blocking fluid communication from the bore in the tubular body, and permitting fluid communication from the bore in the tubular body through the fluid inlet port when in the open port position;

a seat supported on the port closure member, such that an increase in fluid pressure to the fluid inlet port when a plug lands on the seat shifts the port closure member from the port isolation position to the open port position in response to fluid pressure above the landed plug; and a plug release mechanism for releasing the plug after the port closure member has moved to the open port position.

2. The retrievable tool as defined in claim 1, wherein the port closure member comprises a sleeve axially moveable within the bore of the tubular body.

3. The retrievable tool as defined in claim 1, wherein the fluid pressure responsive member includes a piston moveable from the initial position to the activated position in response to fluid pressure.

4. The retrievable tool as defined in claim 3, wherein the piston moves axially upward from the initial position to the actuated position in response to fluid pressure.

5. The retrievable tool as defined in claim 1, wherein the plug is a ball.

6. The retrievable tool as defined in claim 5, wherein the ball lands on the seat to substantially seal off the bore through the tubular body.

7. The retrievable tool as defined in claim 1, wherein the port closure member is retained in the port isolation position by a shear member.

8. The retrievable tool as defined in claim 1, wherein the seat permanently deforms in response to increased fluid pressure to pass the plug through the seat.

9. A retrievable liner hanger running tool for running in a wellbore to perform a downhole tool actuation on a liner hanger, the running tool comprising:

a running tool tubular body for suspending in the wellbore from a conveyance tubular, such that fluid may be circulated through a bore in the conveyance tubular and in the tubular body, the tubular body including a fluid inlet port from the bore in the tubular body;

a piston axially moveable with respect to the tubular body and in fluid communication with the fluid inlet port, the piston being moveable from an initial position to an activated position in response to fluid pressure within the tubular body, axial movement of the piston to the activated position causing one of (a) axial movement of a slip to set the liner hanger, (b) movement of a release mechanism to release the liner hanger from the running tool, and (c) relative movement between a cone and a seal to seal between the liner hanger and surrounding casing;

a port isolation member axially movable with respect to the tubular body from a port Isolation position to an open port position, the port isolation member in the port isolation position blocking fluid communication from the bore in the tubular body, and permitting fluid communication from the bore in the tubular through the fluid inlet port when in the open port position;

a seat supported on the port closure member, such that an increase in fluid to the fluid inlet port when a ball lands on the seat shifts the port closure member from the port isolation position to the open port position in response to fluid pressure above the landed ball; and a plug release mechanism for releasing the ball after the port closure member has moved to the open port position.

10. The running tool as defined in claim 9, wherein the piston moves axially upward from the initial position to the actuated piston in response to fluid pressure.

11. The running tool as defined in claim 9, wherein the ball lands on the seat to substantially seal off the bore through the tubular body.

12. The running tool as defined in claim 9, wherein the sleeve is retained in the port isolation position by a shear member.

13. The relative tool as defined in claim 9, wherein the seat permanently deforms in response to increased fluid pressure to pass the ball through the seat.

14. A method of hydraulically operating a tool for running in a wellbore to perform a downhole tool activation, the method comprising;

suspending a running tool tubular body in the wellbore from a conveyance tubular;

providing a fluid inlet port from a bore in the tubular body;

providing a fluid pressure responsive member In fluid communication with the fluid inlet port and moveable relative to the tubular body from an initial position to an activated position in response to fluid pressure;

providing a port closure member moveable with respect to the tubular body from a port isolation position to an open port position, the port closure member in the port isolation position blocking fluid communication from the bore in the tubular body, and permitting fluid communication from the bore in the tubular through the fluid inlet port when in the open port position;

supporting a seat on the port closure member;

landing a plug on the seat to shift the port closure member from the port isolation position to the open port position in response to fluid pressure above the landed plug;

performing the downhole tool activation in response to movement of the fluid pressure responsive member to the activated position; and releasing the plug after the port closure member has moved to the open port position.

15. The method as defined in claim 14, wherein the fluid pressure responsive member includes a piston moveable from the initial position to the activated position in response to fluid pressure.

16. The method as defined in claim 15, wherein the piston moves axially upward from the initial position to the actuated position in response to fluid pressure.

17. The method as defined in claim 14, wherein the plug is a ball which lands on the seat to substantially seal off the bore through the tubular body.

18. The retrievable method as defined in claim 14, further comprising:

retaining the port closure member in the port isolation position by a shear member.

19. The method as defined in claim 14, wherein the seat permanently deforms in response to increased fluid pressure to pass the plug through the seat.

20. The method as defined in claim 14, wherein movement of the fluid pressure responsive member causes one of (a) axial movement of a slip to set the liner hanger, (b) movement of a release mechanism to release the running tool tubular body from the running tool, and (c) relative movement between a cone and a seal to seal between the liner hanger and surrounding casing.

21. The method as defined in claim 14, wherein the plug is released after the downhole tool has been activated in response to movement of the fluid pressure responsive member to the activated position.

* * * * *